United States Patent [19]

Bomberger

[11] Patent Number: 4,463,926

[45] Date of Patent: Aug. 7, 1984

[54] ASSEMBLY OF CASING ELEMENTS FOR POURING OF CONCRETE

[75] Inventor: Werner Bomberger, Uster, Switzerland

[73] Assignee: GIBA AG Gesellschaft für Industrialisierung in Bauwesen, Baar, Switzerland

[21] Appl. No.: 433,398

[22] Filed: Oct. 8, 1982

[30] Foreign Application Priority Data

Oct. 19, 1981 [CH] Switzerland ..... 6.661/81

[51] Int. Cl.³ ..... E04G 11/06

[52] U.S. Cl. ..... 249/47; 249/192; 249/219 R

[58] Field of Search ..... 249/47, 192, 219 R, 249/134; 264/316, 337

[56] References Cited

U.S. PATENT DOCUMENTS

| | | | |
|---|---|---|---|
| 2,055,977 | 9/1936 | Hayes | 249/192 |
| 3,475,265 | 10/1969 | Santry | 264/337 |
| 4,003,545 | 1/1977 | Tanaka | 425/DIG. 44 |
| 4,280,677 | 7/1981 | Shahar | 249/47 |

*Primary Examiner*—Donald E. Czaja
*Assistant Examiner*—M. A. Becker
*Attorney, Agent, or Firm*—Shoemaker and Mattare, Ltd.

[57] ABSTRACT

There is provided a form of assembled elements for pouring concrete, the form consisting primarily of elements made of synthetic materials. These elements include a molding face of elastomer, a rear face having grooves, an envelope filler of rigid foam, and edges having a reinforced lip and attachment points for assembly means. The form includes a reinforcing framework made of metallic profile members. It is maintained in place by a support scaffold of triangular trellis construction. The elements have a size and weight which permits them to be handled by a single person.

13 Claims, 14 Drawing Figures

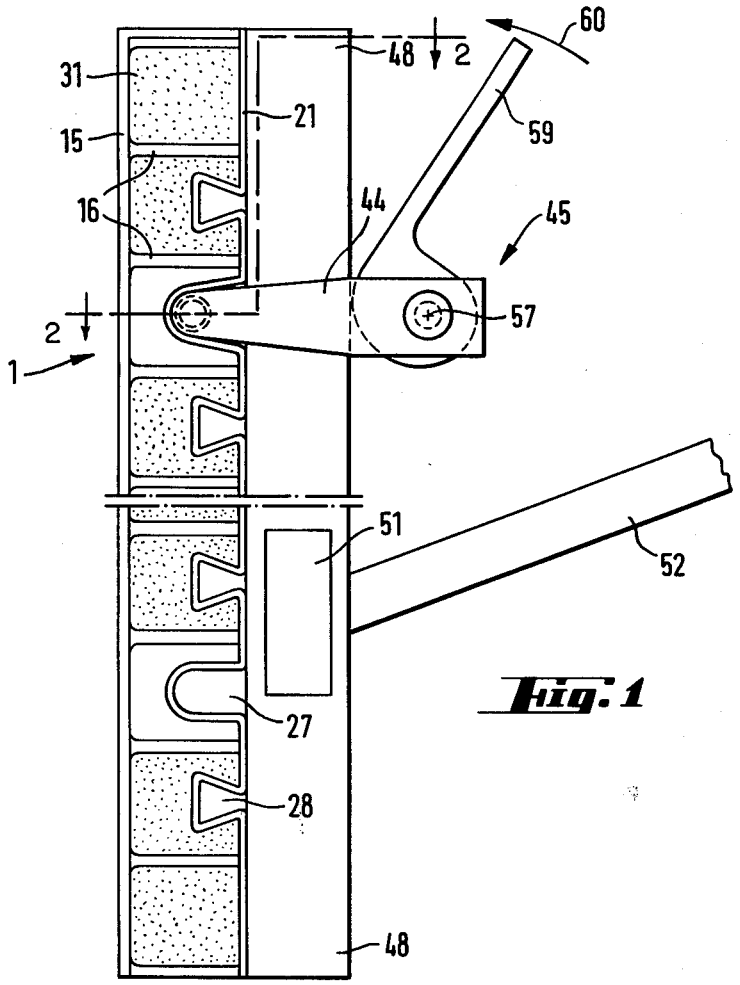
Fig. 1
Fig. 2
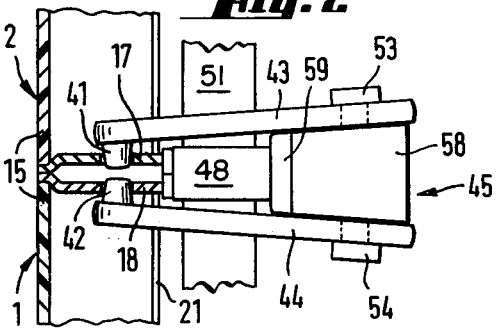
Fig. 3
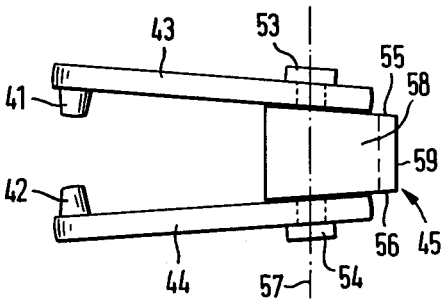

Fig. 4
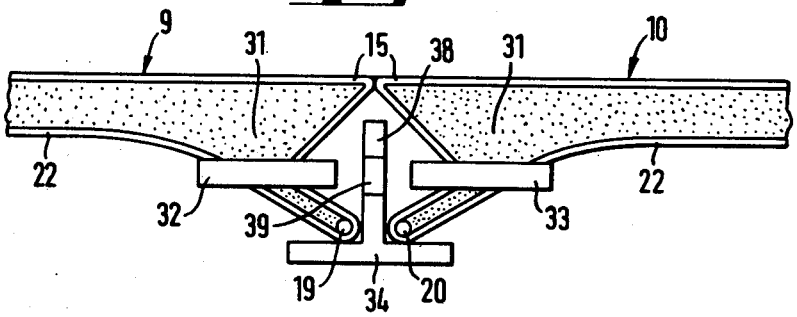
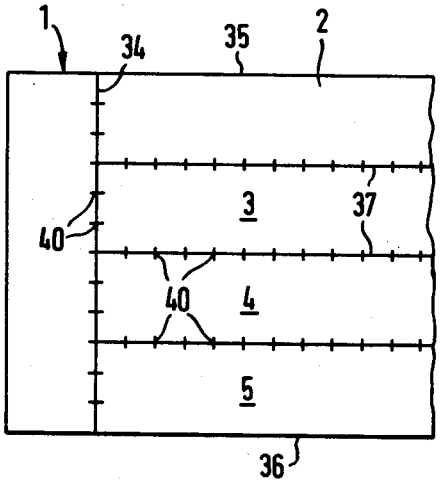
Fig. 5
Fig. 6 Fig. 7 Fig. 8
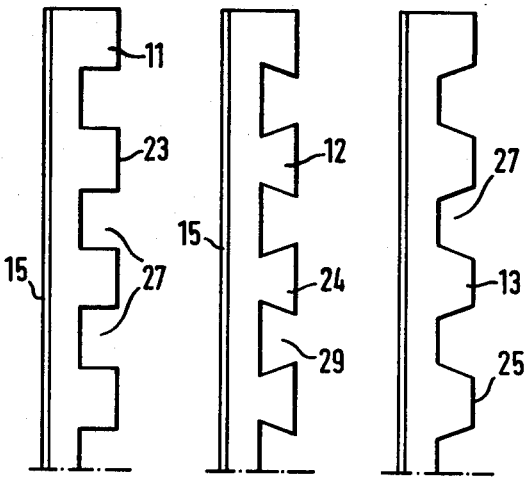
Fig. 9
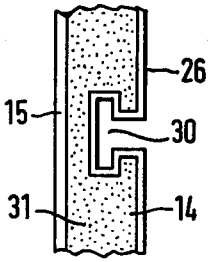

(C-C)

(A-A)

ASSEMBLY OF CASING ELEMENTS FOR POURING OF CONCRETE

TECHNICAL FIELD

The present invention relates to a form of assembled multiple elements for the pouring of concrete, generally a vertical form.

PROBLEM TO BE SOLVED

This invention aims to permit the pouring of concrete between two generally vertical forms which constitute the whole height of a wall, something that has been done for a long time with metal forms. However, in the present case, it is desired to try to accomplish this operation with forms made of relatively light components, so that they can be handled by a single man.

STATE OF THE PRIOR ART AND ITS DISADVANTAGES

Vertical forms have been described in French Pat. Nos. 1,277,437 of Oct. 13, 1960, and 2,149,696, of Aug. 18, 1971. These include vertical panels constituting the whole height of a wall and weighing several hundreds of kilograms, and are maintained by supporting frames which are very strong but cumbersome, and which must be disassembled in order to avoid damage during transport or during handling in the yards.

This material thus requires substantial handling apparatus which does exist in the large yards, but which would be too difficult to use on, for example, the small construction sites for individual houses.

Moreover, the metal forms give rise to difficulties during the removal of the forms from the concrete, and necessitate the use of special release oils for such removal.

In any event, it is impossible to nail accessories on them, as can be done with plywood forms, for example. An aim of an aspect of the present invention is to eliminate these various disadvantages.

GENERAL DESCRIPTION OF THIS INVENTION

Accordingly, this invention provides a form of assembled elements for pouring concrete. The form comprises, in combination:

(a) a plurality of panels of synthetic material, each including:

1. a hollow envelope of hard and flexible material with
   - (i) a molding face corresponding to the shape to be given to the wall, the said face being composed of elastomer,
   - (ii) reinforcements, preferably of steel, inserted in the edges of the panels,
   - (iii) a rearward face;
2. within the envelope a filler of rigid foam of synthetic material that is compatible with and adheres firmly to the envelope;
3. edges including a reinforced lip and attachment points for assembly means;

(b) a reinforcing framework constituted by metallic profiles located at the junctions between pairs of panels;

(c) a support scaffold in the form of a triangular trellis conforming at the rear of the form to the profiles of the reinforcing framework;

(d) simultaneous assembly means for the panel, the reinforcing framework and the support scaffold;

each of the elements of the assembly, namely the panels, the reinforcing framework and the scaffold, having separately a size and a weight which renders them easily manipulable by a single man.

It will be understood that an important characteristic of the invention lies in the fact that the molding face is of an elastomeric material, behind which is located a filling of rigid, high density plastic foam, which fills up the hollow centre of the panel. The rear portion of the latter is closed either by a metal wall or by a wall of synthetic material, either one being treated or arranged so that it will adhere perfectly to the high density rigid plastic foam.

According to a first embodiment, the edges include sockets of which the axes are parallel to the panel medians and which are regularly spaced so that they are in alignment with each other when all of the panels are assembled, the latter being separated by a framework of T-profiles of which the centre flange is placed between the panels and has holes corresponding to the sockets, to permit the passage of assembly bolts.

According to a second embodiment, the edges are provided with metallic bands perpendicular to the molding face, with holes located in relation to panel slots allowing the insertion of the jaws of a clamp assembly.

This clamp assembly comprises two jaws terminating in pins or hooks intended to engage the edge holes, and are maintained at their other extremities by head members located along an axis against the oblique bases of an eccentric cylinder which includes a maneuvering handle, the bases being symmetrical with respect to a median plane perpendicular to the axis of the cylinder, the position of the handle, of the axis, and of the inclination of the bases being such that:

- in one position of the handle, the jaws are spread apart and the surface of the cylinder is at its furthest distance from the pins or hooks,
- whereas, in another position of the handle, diametrically opposed to the first, the jaws are brought close to one another and the surface of the cylinder approaches the pins so as to grip a member of the support scaffolding or one of the sections of the reinforcing framework.

The fabrication of a panel in accordance with the invention can be carried out as follows, for example:

The rear face is of fibreglass reinforced polyester. This face is made in a wooden or metallic mold. In this operation, one incorporates reinforcements and attachment points. Polycondensation is effected at a temperature of the order of 60° C.

On the other hand, for example, the concrete-molding face can be made by laying up a polyurethane elastomeric film on a support having a plain, smooth surface, the film forming after cross-linking a layer with a Shore hardness number of approximately 90, and a density of 1.1–1.2. While this film is still pasty, a layer of polyurethane in the liquid state is deposited thereon, forming foam. The previously fabricated rear face is then placed against this composite, after reversing it. The rear face is strongly pressed on the plane surface, thus imprisoning the polyurethane which, by expansion, will fill the entire volume between the concrete molding face and the rear face.

The expansion of the foam requires approximately ten minutes at ambient temperature.

According to another method of manufacture, the panel is made by injecting into a mold a mixture of appropriate polyols and di-isocyanates, forming a polyurethane foam. The formulations are chosen so that, upon contacting the walls of the mold, they will form a more or less thick skin, depending on the temperature and pressure. In this manner, the panel can be totally of polyurethane.

SOLUTION TO THE PROBLEM, ADVANTAGES AND INDUSTRIAL RESULT

The concrete form of the invention has the advantage of being composed of panels of reduced dimensions, for example, 2.7 meters high and 0.675 meters wide, which include a groove structure on their rear faces, permitting them to be easily handled. Their weight is generally less than 45 Kg.

However, the internal surfaces of the hollow envelope of hard and flexible material of the synthetic panels are treated in such a way as to ensure that the foam will adhere thereto. This treatment is sometimes of no use when the concrete forming face is solely of polyurethane elastomer.

By using a concrete-forming face made of polyurethane elastomer it is possible to avoid having to use releasing oil, since this material is self-releasing.

It is also possible to nail accessories on the molding face in the same manner as is done on a plywood molding face.

As to the reinforcing framework, this is composed of rectilinear members which are simple to put into position.

Finally, the maintaining scaffold in the form of a triangular trellis is made of tube stock and is very light.

The entire assembly can thus be manually put together easily by one or two men without requiring lifting apparatus.

The invention will be better understood with the help of the following description which gives several non-limiting practical embodiments, and which are illustrated in the attached drawings.

GENERAL DESCRIPTION OF THE DRAWINGS

FIG. 1 is a vertical section through a concrete-molding form according to the invention, taken perpendicular to the molding face and showing a panel with horizontal grooves, a portion of the supporting trellis scaffold, and a means of assembling these two elements together;

FIG. 2 is a horizontal section of the same assembly of two panels and a support scaffold, taken at the level of an assembly clamp;

FIG. 3 is a plan view of the assembly clamp in the open position;

FIG. 4 is a horizontal section of a variant of an assembly of two panels, taken at the level of the assembly sockets and of the profile of the reinforcing frame;

FIG. 5 is an elevational schematic view of an assembly of several panels;

FIGS. 6, 7 and 8 are vertical sections showing three variants of the panel of this invention;

FIG. 9 is a partial sectional view of a panel, taken perpendicularly to the axis of a groove which has a narrower width at the opening edge than at the bottom, and which is adapted to receive the head of a screw;

DETAILED DESCRIPTION OF THE DRAWINGS

Figure 10:
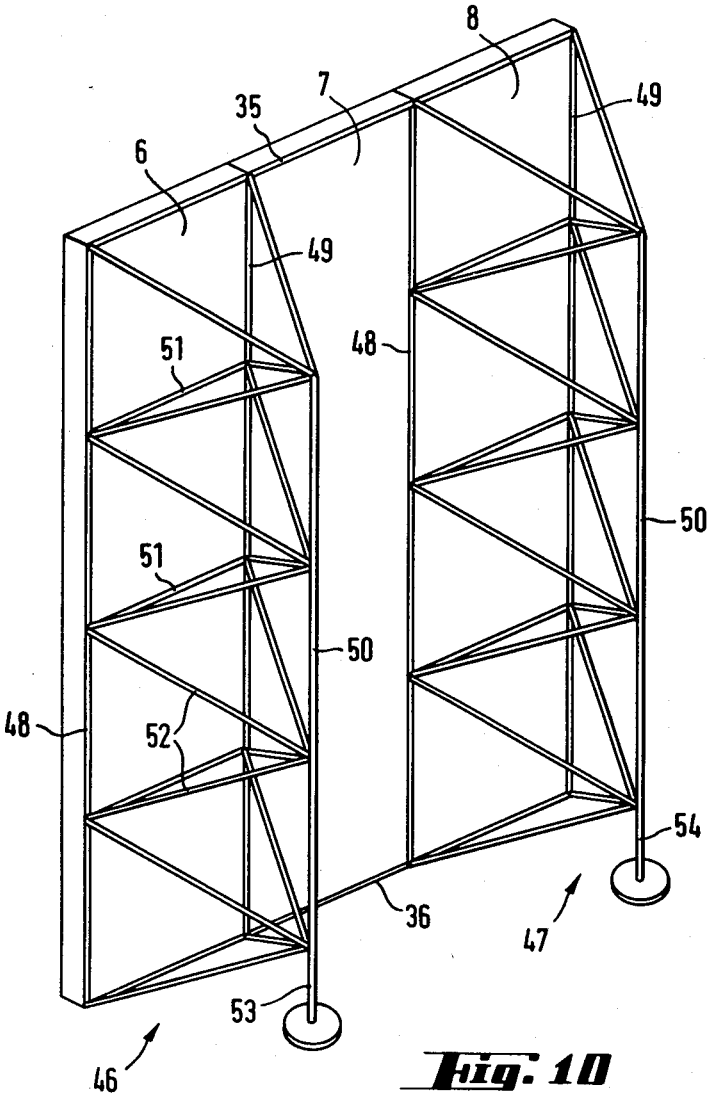
FIG. 10 is a rear perspective view of a panel assembly supported by two support scaffolds of triangular trellis form.
Figure 11:
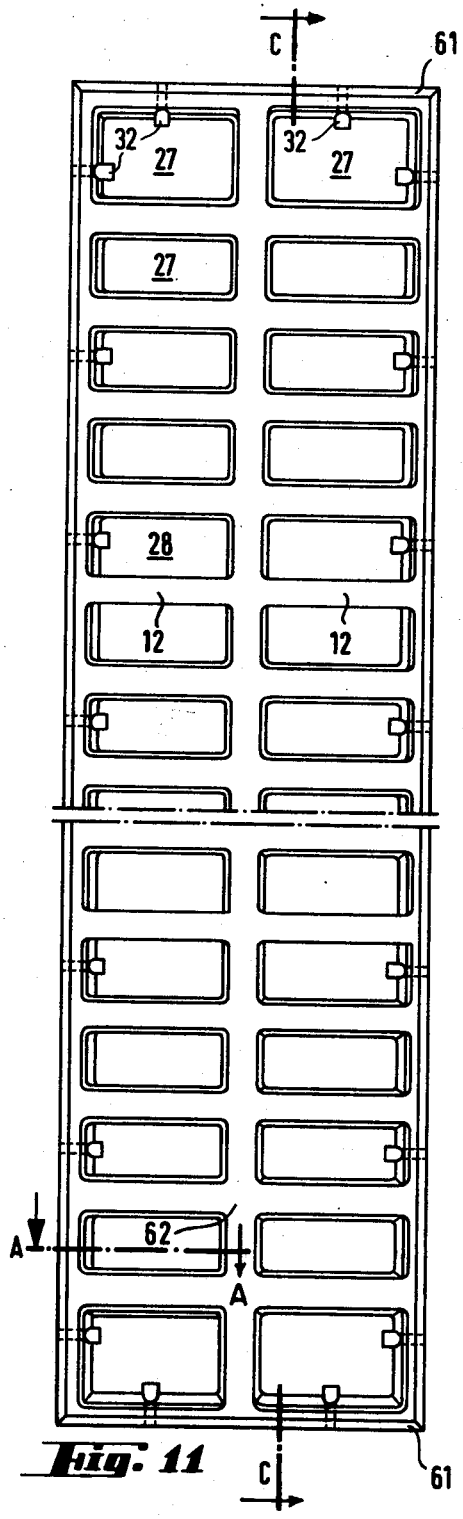
FIGS. 11 and 12 are elevational views of two panel variants.
Figure 12:
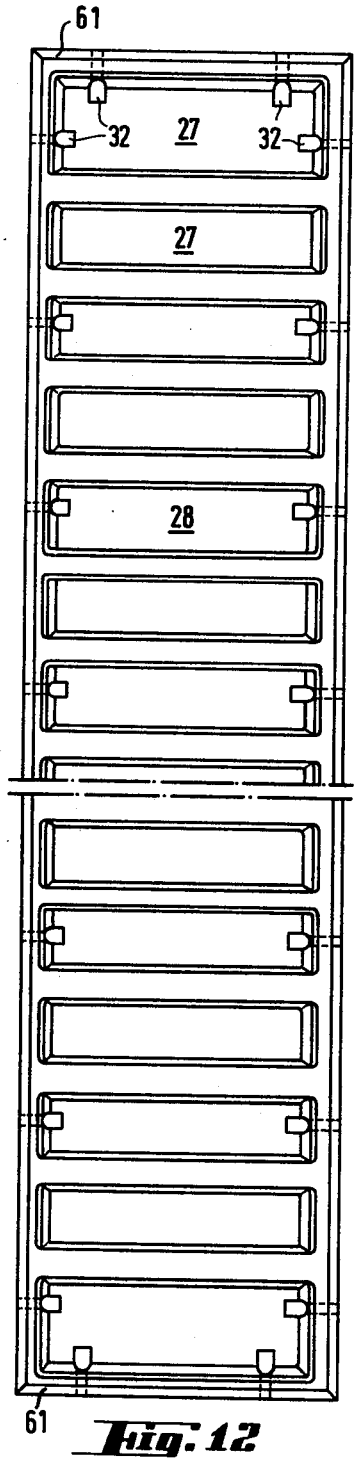
Figure 13:
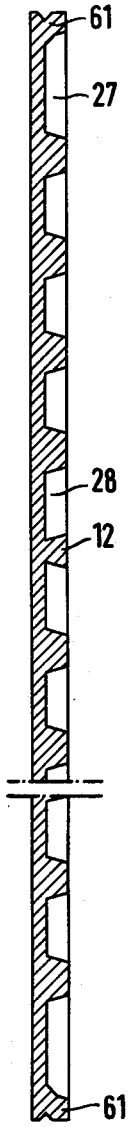
FIG. 13 is a sectional view taken at the line C—C in FIG. 11.
Figure 14:
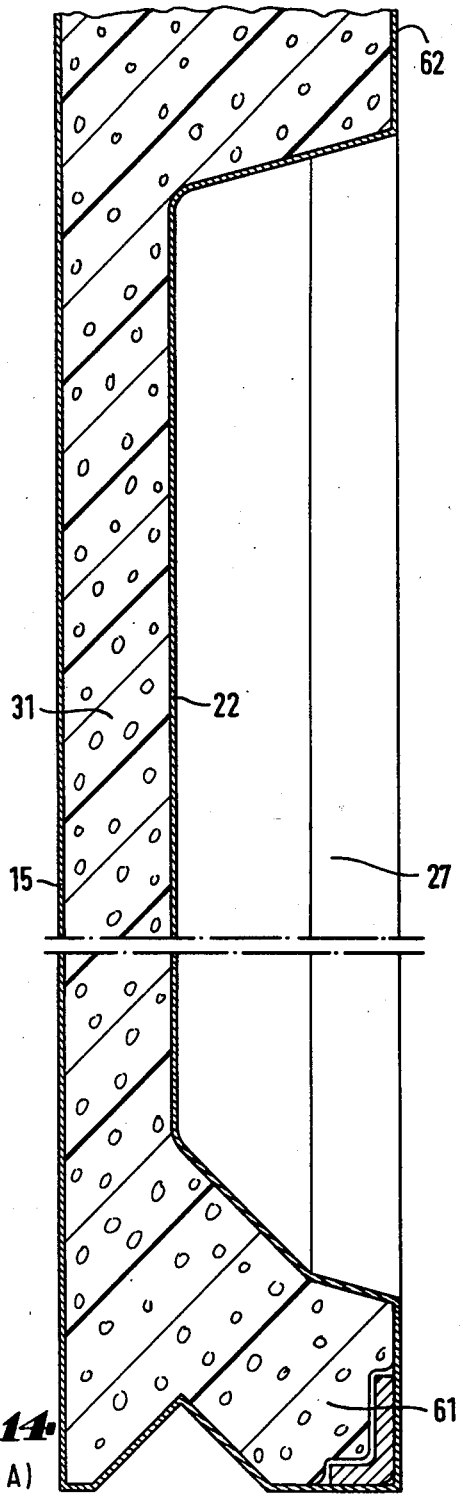
FIG. 14 is a sectional view taken at the line A—A in FIG. 11.

Each of the panels 1–14 of the concrete molding form of the invention are composed of a hollow envelope of polyurethane elastomer, of which the rear face may be of polyester. The polyurethane has the advantage of being resistnt to abrasion, tearing, chemical products and oxidation due to weathering, and also permits relatively easy mold removal. The hollow envelope of the panel includes a molding face 15, corresponding to the shape to be given to the wall and which is generally flat, a posterior reinforcing grid 16 for the molding face 15, optional reinforcements 17, 18, 19 and 20 generally of steel and inserted in the edges of the panels, and a rear face 21, 22, 23, 24, 26 which includes grooves 27 of which certain ones 28; 29 and 30 have a narrower width at the opening edge than at the base. The rear face may be reinforced by a reinforcing plate (62) perpendicular to the grooves (FIGS. 11 and 14).

To hollow envelope, constituted by the concrete-molding face 15, the edge reinforcements 17, 18, and the rear faces 21, 22, 23, 24, 25, 26, is filled with a rigid foam of high density plastic material with the property of being compatible with and adhering firmly to the envelope. This plastic material filler may advantageously be constituted by a rigid polyurethane foam having a high density on the order of 200 kg/m$^3$.

The borders of the panels 1–14 include reinforced edges 61. This may involve metallic profiled bands 17, 18 which may be spaced from one another (FIG. 2) and having holes through which the pins of assembly clamps may be engaged, as will be seen subsequently. the reinforced edges may also be reinforcements 19, 20 (see FIG. 4) inserted internally of the polyurethane foam 31 including receptacles or sockets 32, 33 of which the axes are parallel to the medians of the panels 9 and 10, which are spaced regularly so as to be located in registry with each other in the assembly of the said panels 9 and 10. It should be remarked that, in this case, the concrete-molding faces 15 extend in a continuous manner toward the rear faces 22 which are constituted by plastic material in which is incorporated a glass cloth.

The concrete form further comprises a reinforcing framework constituted by shaped sections 34, 35, 36 and 37. These metallic sections are located at the junctions between adjacent panels 1–14. They have generally a T-section of which the central web 38 is located between the panels, and they include holes 39 related with respect to the corresponding receptacles 32 and 33, to permit the insertion of assembly bolts (see FIG. 4).

Referring now to FIG. 5, it is seen that the assembly bolts 40 are conveniently distributed at the junctions of the panels 1–5.

If one refers now to FIGS. 1 and 2, it can be seen that the edges are provided with reinforcements or metallic bands 17 and 18, perpendicular to the concrete-forming faces 15, and having holes related with respect to the grooves 27 of the panels, permitting the introduction of the pins 41, 42 of the jaws 43, 44 of an assembly clamp 45.

A third component of the concrete form of the invention is constituted by support scaffolds 46 and 47 in the form of a triangular trellis, these being conformed to the rear of the concrete form and particularly to the member 34 of the metallic sections of the reinforcing framework. These supporting scaffolds are each constituted by three upright members 48, 49 and 50, the members 48 and 49 being tied by transverse horizontal members such as 51 while the upright member 50 is connected to the other upright members by oblique connecting members such as 52. The structure of the scaffolds 46, 47 is one frequently found in tubular metallic construction. The base of the upright members 50 includes vertical adjustment screws 53, 54. The upright members 48, 49 are placed against the reinforcements 17, 18 or the members such as 34, with the help of the assembly clamps 45.

In practice the weight of each panel 1–14, the reinforcing members 34–37, and the scaffolds 46, 47 does not individually exceed 45 Kgs, and all of these may be handled easily by a single man. An advantage of the grooves 29, which are narrower at the edge than at the base, is that they permit an easy grip on the panel 12 by the person who wishes to handle it (see FIG. 7).

In certain cases, there is provided a groove having a T-shaped section 30 permitting reception of the head of a bolt used to secure sectional members or the uprights 48 and 49 of the scaffolds 46 and 47 (see FIG. 9).

However, most of the time it will be advantageous to use the assembly clamp 45 which will now be described in greater detail.

The clamp 45 includes two jaws 43, 44, which terminate in pins 41, 42 intended to be engaged in the holes of the edge reinforcements 17 and 18. The jaws 43 and 44 are secured, at their other extremity, by head members 53, 54 located on oblique bases which are symmetrical with respect to a median plane perpendicular to the axis 57 of an eccentric cylinder 58 which includes a maneuvering handle 59. The handle 59 permits rotation of the cylinder 58 about the axis 57 and, during this movement, if the jaws 43 and 44 are held against rotation, they will pass continuously through phases in which they first approach each other and then move further away. In the position of FIG. 3 (handle 59 remote from the pins 41, 42), the jaws 43, 44 are separated.

In the position of FIG. 2 (handle 59 closest to the pins 41, 42), the jaws 43, 44 are close to each other, and the pins 41, 42 grip the reinforcements 17, 18.

Furthermore, the axis 57 is eccentric with respect to the outer wall of the cylinder 58. This eccentricity in such that the wall of the cylinder is at its maximum elongation from the pins 41, 42 (FIG. 3) when the jaws 43, 44 are spread apart, whereas the wall of the cylinder 58 is closest to the pins 41, 42 when the jaws 43, 44 are closest to one another (FIG. 2).

In these conditions, when one causes the jaws 43, 44 to wedge the pins 41, 42 into the corresponding holes of the reinforcements 17 and 18, and when an upright member such as 48 of the scaffolds 46, 47 has been placed against the metallic sections 34, and when the clamp assembly 45 has been placed against the edges of two of the panels 1–14 while the cylinder 58 is against the upright member 48, the rotation of the handle 59 in the sense of the arrow 60 has the effect not only of bringing together the two panels such as 1 and 2, but also of firmly pressing the cylinder 58 against the upright member 48, and the latter against the panels 1 and 2, or at least against the section which is at their junction.

I claim:

1. A form of assembled elements for pouring concrete, comprising, in combination:

(a) a plurality of panels of synthetic material, each including:

1. a hollow envelope of hard and flexible material with
   - (i) a molding face corresponding to the shape to be given to the wall, the said face being composed of elastomer,
   - (ii) reinforcements, preferably of steel, inserted in the edges of the panels,
   - (iii) a rear face;
2. within the envelope a filler of rigid foam of synthetic material that is compatible with and adheres firmly to the envelope;
3. edges including a reinforced lip and attachment points for assembly means;

(b) reinforcing means including metallic sections located at the junctions between pairs of panels;

(c) a support scaffold in the form of a triangular trellis conforming at the rear of the form to the metallic sections of the reinforcing means;

(d) assembly means for the panels, the reinforcing means and the support scaffold for simultaneously holding all together;

each of the elements of the assembly, namely the panels, the reinforcing framework and the scaffold, having separately a size and a weight which renders them easily manipulable by a single man.

2. The form according to claim 1, in which the rear face of the hollow envelope is metallic.

3. The form according to claim 1, in which the rear face of the hollow envelope is of polyurethane elastomer.

4. The form according to claim 1, in which the molding face is of polyurethane elastomer.

5. The form according to claim 1, in which the rear face of the hollow envelope is of reinforced polyester.

6. The form according to claim 1, in which the panels include a molding face made of an elastomer reinforced by glass fibres or by a metallic grid.

7. The form according to claim 1, in which the rear face has grooves.

8. The form according to claim 7, in which the grooves are narrower at the rear face than at the groove base.

9. The form according to claim 7, in which the grooves are interrupted by a perpendicular reinforcing band.

10. The form according to claim 1, in which the envelope includes a reinforcing grid posterior to the molding face.

11. The form according to claim 1, in which the panel edges have sockets of which the axes are parallel to the panel medians, the sockets being regularly spaced and being located opposite one another in the assembly of the said panels, the latter being then separated by a framework of T-profiles of which the central web is located between the panels and has holes corresponding to the sockets to permit entry of assembly bolts.

12. The form according to claim 1, in which the panel edges have metallic bands perpendicular to the molding face, with holes located with respect to grooves in the panels permitting the introduction of the jaws of an assembly clamp.

13. The form according to claim 12, in which the clamp assembly has two jaws terminating in pins adapted to engage the holes of the metallic bands of the panel edges, and maintained at their other extremities by head members located on oblique bases which are symmetrical with respect to a median plane perpendicular to the axis of an eccentric cylinder which has a manoeuvering handle, the position of the handle and the axis, and the inclination of the bases, being such that in one position of the handle, the jaws are separated and the cylindrical surface is at its furthest separation from the pins, whereas, in another position of the handle, diametrically opposite the first, the jaws are close to one another, and the cylinder wall is close to the pins so that it may secure a member of the support scaffold or a section member of the reinforcing framework.

* * * * *